US005986398A

United States Patent [19]

Makino

[11] Patent Number: 5,986,398

[45] Date of Patent: Nov. 16, 1999

[54] FIELD EMISSION DISPLAY DEVICE

[75] Inventor: Tetsuya Makino, Tokyo, Japan

[73] Assignee: Sony Corporation, Tokyo, Japan

[21] Appl. No.: 08/953,643

[22] Filed: Oct. 17, 1997

[30] Foreign Application Priority Data

Oct. 18, 1996 [JP] Japan ..... 8-276502

[51] Int. Cl.[6] ..... H01J 31/15

[52] U.S. Cl. ..... 313/495; 313/497; 313/466; 313/474

[58] Field of Search ..... 313/495, 496, 313/497, 466, 474

[56] References Cited

U.S. PATENT DOCUMENTS 5,477,105 12/1995 Curtin et al. ..... 313/496
5,576,596 11/1996 Curtin et al. ..... 313/496
5,725,787 3/1998 Curtin et al. ..... 313/466
5,814,934 9/1998 Tsai ..... 313/495

*Primary Examiner*—Ashok Patel
*Attorney, Agent, or Firm*—Hill & Simpson

[57] ABSTRACT

A field emission display device is arranged to improve the (luminance and the contrast and have a fluorescent screen for preventing a fluophor from being stripped off a substrate. The field emission display device includes a cathode electrode, the fluophors excited by electrons emitted by the cathode electrode, an anode electrode to which a given anode voltage is to be applied, and a metal film formed on the fluophors. The metal film is formed to have a thickness in the range of $2\times10^{-6}E<t<\mathbf{2\times10^{-5}E+0.02}$, where t is a thickness of the metal film and E is a voltage to be applied onto the anode electrode.

3 Claims, 9 Drawing Sheets

| ANODE VOLTAGE (kV) | OPTIMAL FILM THICKNESS FOR LUMINANCE (μm) |
|---|---|
| 1 | ABOUT 0.01 |
| 2 | ABOUT 0.022 |
| 3 | ABOUT 0.039 |
| 5 | ABOUT 0.06 |
| 10 | ABOUT 0.08 |

FIELD EMISSION DISPLAY DEVICE

BACKGROUND OF THE INVENTION

1. Field of Industrial Application

The present invention relates to a field emission display device which is arranged to emit light by exciting a fluorescent material with electron rays and more particularly to the field emission display device which is driven at a low anode voltage.

2. Description of the Related Art

As a very thin display device, the so-called field emission display device has been proposed wherein a lot of minute cathode electrodes (micro tips) served as an electron emitting source are formed on each pixel area so that fluophors provided on an anode electrode side are made active by exciting the micro tips of the corresponding pixel areas to a given electric signal.

The field emission display device includes as basic components a cathode electrode, an insulating layer formed on the cathode electrode, gate lines formed on the insulating layer and having lots of openings (gates) formed therein, and micro tips serving as minute cold cathodes located in lots of holes passing from the cathode electrode formed in the insulating layer to the gate line, the micro tips corresponding to the gates. That is, the pixels of the field emission display are composed of lots of electron emitting sources each of which has a cathode electrode, an insulating layer, gate lines, and micro tips.

On the anode electrode side of the display device arranged as described above, as shown in FIG. 1, a fluorescent screen 21 is formed facing the cathode electrode on the lower surface of the anode electrode 20 composed of a glass material. On the fluorescent screen 21, a fluorescent agent is coated in a bandlike manner so that the fluorescent agent bands are formed in parallel to the cathode lines.

On the fluorescent screen 21, fluophors 22 excited by electrons for emitting light and black masks 23 are formed on the side facing to the cathode electrode. Hence, on the lower surface of this fluorescent screen 21, the fluophors 22 are formed and excited by electrons so that this surface of the fluorescent screen 21 is served as the fluorescent screen 21 of the display device 1.

The black masks 23 are located to section lots of fluophors 22. The black masks 23 serve to section the fluophors 22 in a manner to correspond to R, G and B.

The display device arranged as described above is driven as below.

At first, a voltage Vc is applied to the cathode electrode. By applying a larger voltage Vg than Vc to the gate, the cold cathodes are excited to emit electrons. The emitted electrons are accelerated by the anode electrode and then reach the fluophors coated on the anode so that the fluophors operate to be luminous.

In the display device, however, the fluophor 22 formed on the anode electrode emit light onto the cathode electrode side when the electrons emitted from the cathode electrode excites the fluophors 22. Hence, the application of light onto the cathode electrode results in inhibiting contribution of part of emission to the emission from the screen.

Further, the fluophors 22 are formed as opposed to the electron emitting source and are formed on the anode electrode side of the substrate 20. Hence, the fluophor 22 is stripped off the substrate 20 and thereby gas is discharged through the stripped portion. This disadvantageously brings about an electric discharge between the anode electrode and the cathode electrode, which leads to lack of reliability of the display device.

SUMMARY OF THE INVENTION

The present invention is therefore proposed in view of this condition, and it is an object of the present invention to provide a field emission display device which is arranged to improve luminance and contrast and prevent disadvantageous stripping of the fluophor 22.

In carrying out the object in a preferred mode, the field emission display device according to the present invention includes a cathode electrode, fluophors excited by electrons emitted from this cathode electrode for emitting light, and an anode electrode to which a given anode voltage is to be applied and is characterized in that a metal film is formed facing the cathode electrode on the fluophors.

The cathode ray tube display employs the technology of forming the metal film on the fluorescent screen. On the other hand, the field emission display has not employed the technology of forming the metal film on the fluorescent screen because the electrons reaching the anode electrode have small energy.

To cope with this, the present applicant found the fact that assuming that the metal film has a thickness of t [$\mu$m] and the voltage to be applied onto the anode electrode is E [V], the electrons discharged from the cathode electrode pass through the metal film and reach the fluophors if the film thickness is conditioned in the relation of $2\times10^{-6}E<t<2\times10^{-5}E+0.02$ and the emission from the fluophors are reflected onto the front plane of the field emission display device.

Assuming that the metal film has a thickness t [$\mu$m] and the voltage to be applied onto the anode electrode is E [V], the metal film is more remarkable in the foregoing function if the metal film is conditioned in the relation of $6\times10^{-6}E<t<1\times10^{-5}E+0.02$.

The field emission display device arranged as described above includes the metal film formed on the plane of the display opposed to the cathode electrode so that the emission from the fluorescent screen may be reflected onto the front plane of the display device and the stripping of the fluophor may be prevented.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Later, the description will be oriented to the field emission display device according to an embodiment of the present invention with reference to the drawings.

Figure 1:
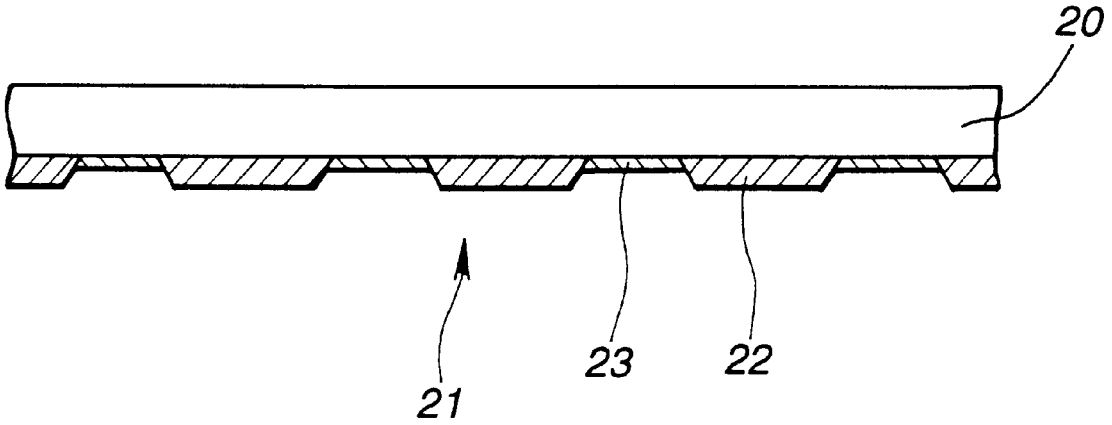
FIG. 1 is a schematic view showing a fluorescent screen formed on the conventional field emission display device.
Figure 2:
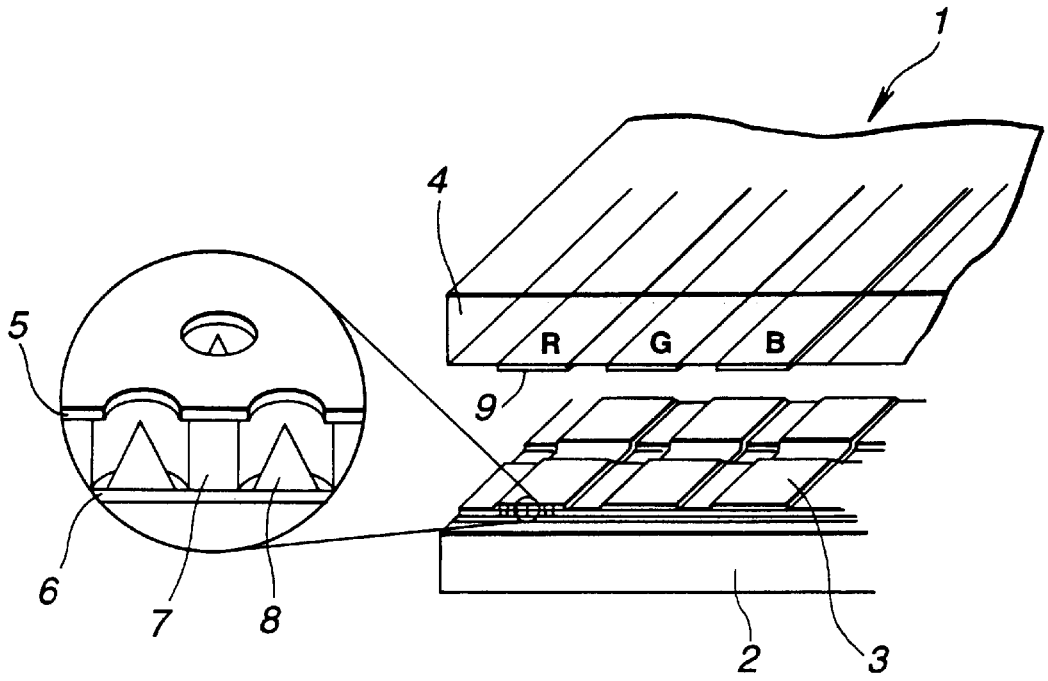
FIG. 2 is a perspective view showing a field emission display device according to an embodiment of the present invention.

As shown in FIG. 2, the field emission display 1 is arranged to have a lower substrate 2 made of a glass material, pixels 3 formed in a matrix manner, and an upper substrate 4 located above the pixels 3. Those pixels are located to keep an equal distance between the adjacent pixels. The gate electrode of each pixel is horizontally formed as a common bandlike gate line 5. The pixels are made active by the scanning operation.

As shown in FIG. 2, each pixel 3 is composed of a cathode line 6, an insulating layer 7 formed on the cathode line 6, a gate line 5 formed on the insulating layer 7 and having lots of openings (gates), and micro tips 8 for emitting the electrons. The micro tips 8 are minute cold cathodes located in lots of holes formed in the insulating layer 7, each of which cathodes passes from the cathode line 6 to the gate line 5 and is located in correspondence with the gate.

The lower main plane of the upper substrate 4 is located as opposed to the main plane of each pixel 3. On the lower main plane of the upper substrate 4, a fluorescent agent is coated so as to form the bandlike fluorescent screen 9 in parallel to the cathode lines 6. That is, about each electron emitting source, the fluorescent screen 9 is formed on the lower surface of the anode electrode.

Figure 3:
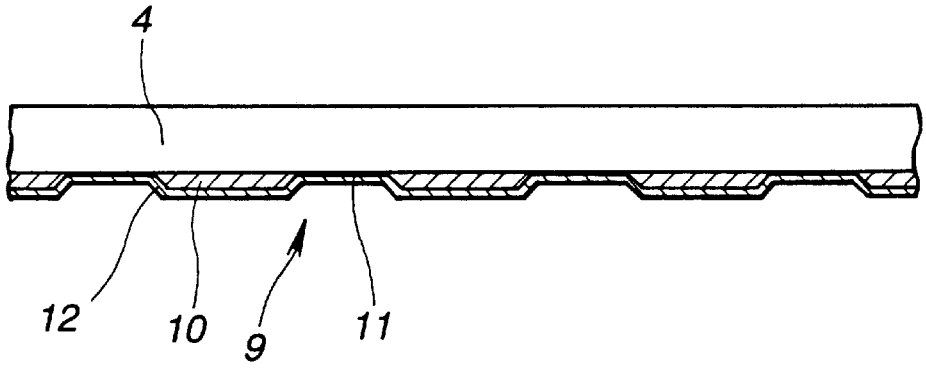
FIG. 3 is a schematic view showing a fluorescent screen formed on the field emission display device.

As shown in FIG. 3, the upper substrate 4 includes fluophors 10 excited by electrons for emitting light, black masks 11, and a metal film 12 formed on the fluophors 10 and the black masks 11, which are formed on the plane of the upper substrate 4 facing the electron emitting source. Hence, the upper substrate 4 includes the fluophors 10 formed on the lower surface thereof so that the lower surface serves as the fluorescent screen 9 of the field emission display device 1.

The fluophors 10 are formed on the side of the upper substrate 4 facing the electron emitting sources. The fluorescent screens 9 formed by coating the fluophors 10 are formed in a bandlike manner and in parallel to the cathode lines 6. The fluophor 10 is preferably made of a metal whose index of dependency of emission efficiency on pressure is about 0.3 to 1.5. For example, the fluophor may be made of $Y_2O_2S$:Eu, ZnS:Cu, Al, ZnS:Ag, Al, $ZnGa_2O_4$:Mn or the like.

The black masks 11 are formed to section lots of fluophors 10 in correspondence with R, G and B.

In this embodiment, the metal film 12 is formed of Al, for example, and is formed on the anode electrode side where the fluophors 10 and the black masks 11 are formed. That is, the metal film 12 faces to the electron emission sources. As the Al film 12 has a more excellent smoothness, the quantity of the reflected light is made larger and thereby the luminance on the front plane of the panel is made larger. Hence, the absolute value of the luminance is variably influenced by the smoothness of the Al film. Hence, in the process for manufacturing the fluorescent screen 9, the Al film 12 is made smoother by forming a middle film between the fluorescent screen 9 and the Al film itself and may be formed to change its luminance depending on the luminance.

As will be indicated below, the Al film 12 is formed to keep the condition of:

$$2\times10^{-6}E<t<2\times10^{-5}E+0.02, \text{ more preferably}$$

$$6\times10^{-6}E<t<1\times10^{-5}E+0.02$$

wherein E [V] is an anode voltage and t [$\mu$m] is a film thickness.

The metal film 12 may be made of not only Al but any material if it enables to reflect the emission from the fluophor 10 made of Pt, Ag or Cr, for example.

The fluorescent screen 9 composed as described above includes the metal film 12 located as opposed to the cathode line 6, so that the emission from the fluophor 10 can be reflected onto the front plane of the panel, thereby enabling to improve the luminance and the contrast and prevent the electric discharge caused by stripping of the fluophor 10.

The fluorescent screen 9 is formed along the manufacturing process shown in FIG. 4. The process for forming the Al film 12 on the upper substrate 4 as opposed to the cathode line 6 side of the fluophor 10 and the black mask 11 is composed of a process for forming a middle film 13 between the fluophor 10 and the Al film 12, a process for forming the Al film 12 on the middle film 13, and a process for gasifying the middle film 13 for removal.

Figure 4A:
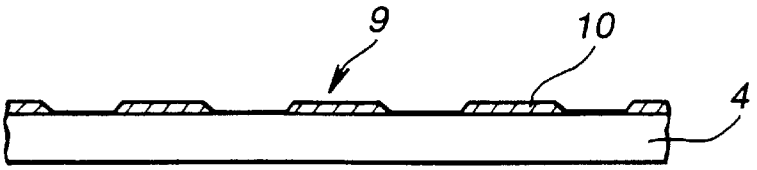
FIG. 4 is a schematic view showing a process for forming a metal film formed on the fluorescent screen.

The process for forming the Al film 12, as shown in FIG. 4A, needs to prepare a panel having the fluophors 10 and the black masks 11 formed on the upper substrate 4.

Figure 4B:
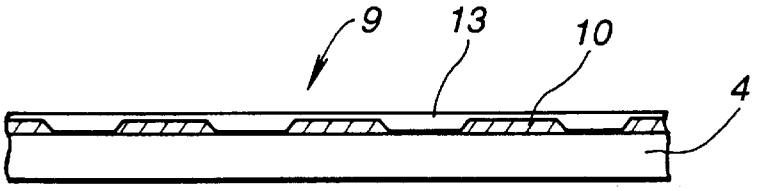

Next, as shown in FIG. 4B, the process for forming the middle film 13 between the fluophors 10 and the Al film 12 is executed to form an acrylic film on the fluophors 10 and the black masks 11.

Figure 4C:
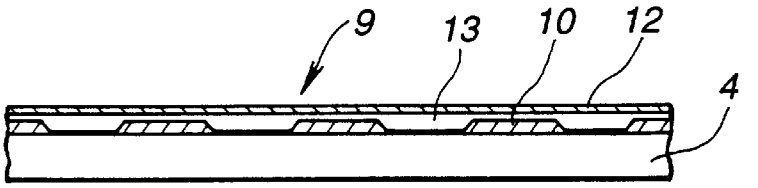

Then, as shown in FIG. 4C, the process for forming the Al film 12 on the middle film 13 is executed to form the Al film 12 on the middle film 13.

Figure 4D:
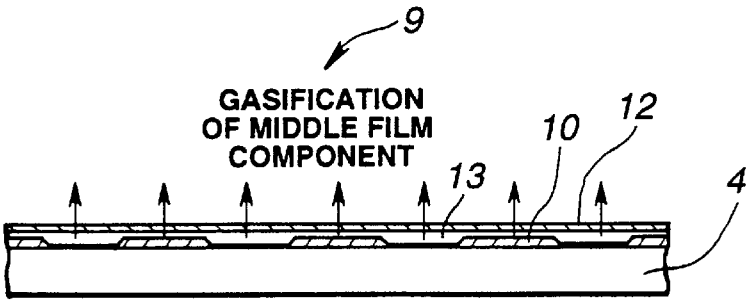
Figure 4E:
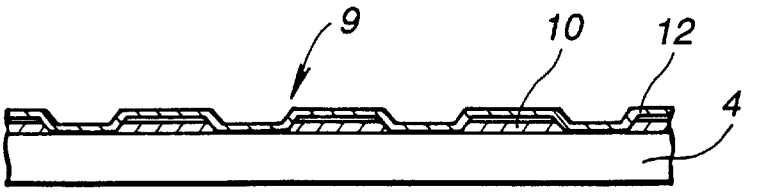

Next, as shown in FIG. 4D, the process for gasifying the middle film 13 for removal is executed to heat the middle film for gasifying the components of the middle film.

The Al film 12 formed as described above, as shown in FIG. 4E, is formed on the fluophor 10 with excellent smoothness. Hence, the Al film 12 does not have any influence on an absolute value of the emission efficiency of the fluophor 10 and enables to reflect the emission and thereby improve the luminance.

The fluorescent screen 9 is composed as described above so that the fluophors 10 are excited for emitting light by applying a voltage onto the anode electrode. Hence, the electrons emitted from the micro tips 8 are allowed to pass through the Al film 12. When forming the fluorescent screen 9, the Al film 12 is required to define the optimal thickness as considering various factors such as a luminance of the Al film toward the front plane of the panel depending on kinetic energy of electrons for exciting the fluorescent screen 9 and a reflection factor of light of the Al film.

The Al film 12 formed as opposed to the cathode lines 6 of the fluophors 10 are required to have an allowable thickness for passing electrons, because the fluophors are excited by the electrons for emission.

Figure 5:
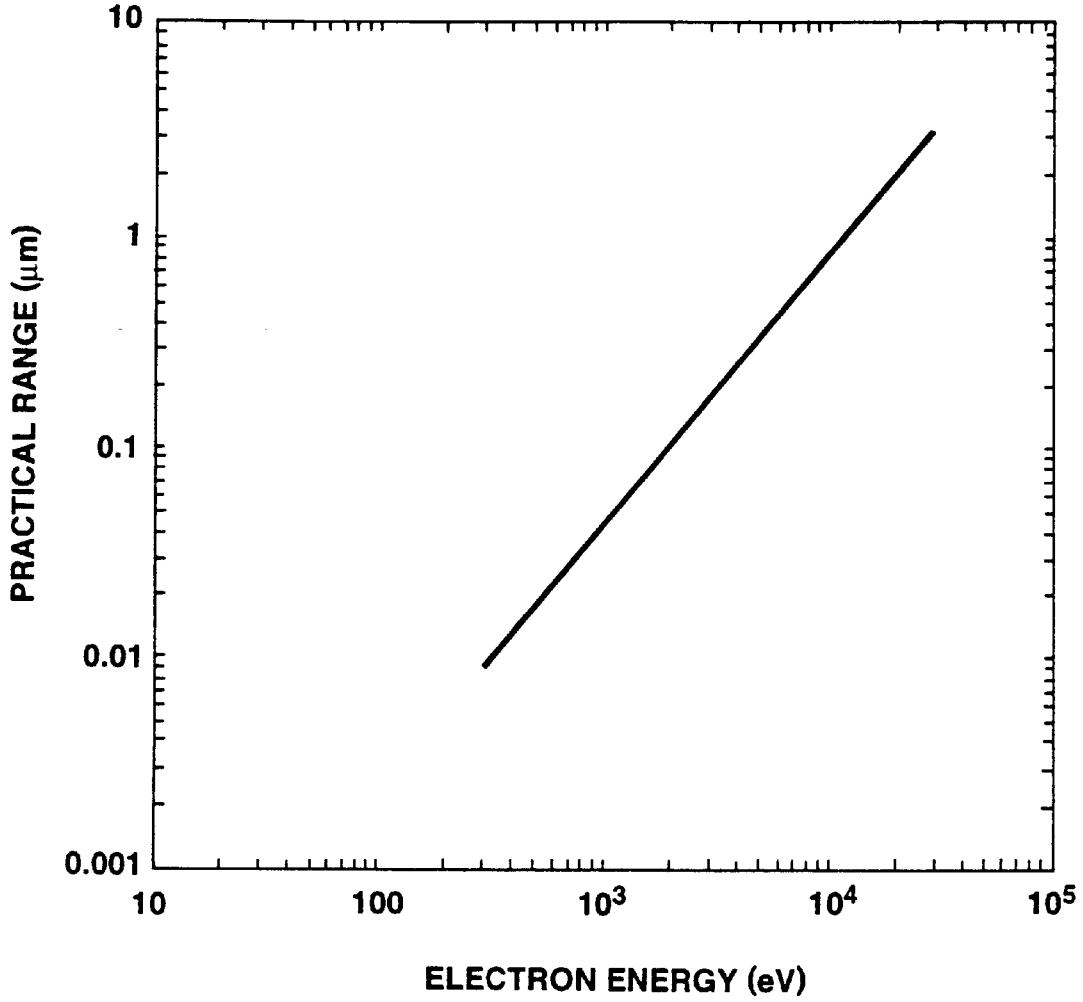
FIG. 5 is a graph showing energy dependency of electrons in a practical range when the metal film is made of aluminium (AI)

That is, the Al film 12 shows a practicable range against the kinetic energy of electrons as shown in FIG. 5. FIG. 5 shows the practical range on an axis of ordinance and electron energy on an axis of abscissa. According to the graph of FIG. 5, when the electron kinetic energy is about 200 [eV], the practicable range is made to be about 0.01 [μm]. As the electron kinetic energy is made larger, the practicable range is made longer in proportion. When the electron kinetic energy is about $2\times10^4$ [eV], the practicable range is about 2 [μm].

The present embodiment uses Al as a material of the metal film.

FIG. 5 shows the kinetic energy appearing when the electrons emitted from the micro tips 8 are absorbed by the Al film. The electrons emitted from the micro chips 8 pass the Al film 12 formed on the anode electrode of the fluophors 10 so that those electrons serve to excite the fluophors 10 for luminous emission. Hence, the thickness of the Al film 12 is determined on the foregoing practicable range.

As the Al film 12 is made thicker, it is necessary to more increase the kinetic energy of the electrons for exciting the fluophors 10 for luminous emission. Hence, the electrons are required to be emitted by applying a high voltage. On the other hand, by making the Al film 12 thin, it is possible to make the fluophors 10 active by virtue of small kinetic energy of the electrons. For example, when the electrons are discharged from the cathode electrode so that the electron kinetic energy becomes about 200 [eV], the Al film 12 is formed to have a thickness of about 0.01 [μm] or less for making the fluophors 10 active.

Figure 6:
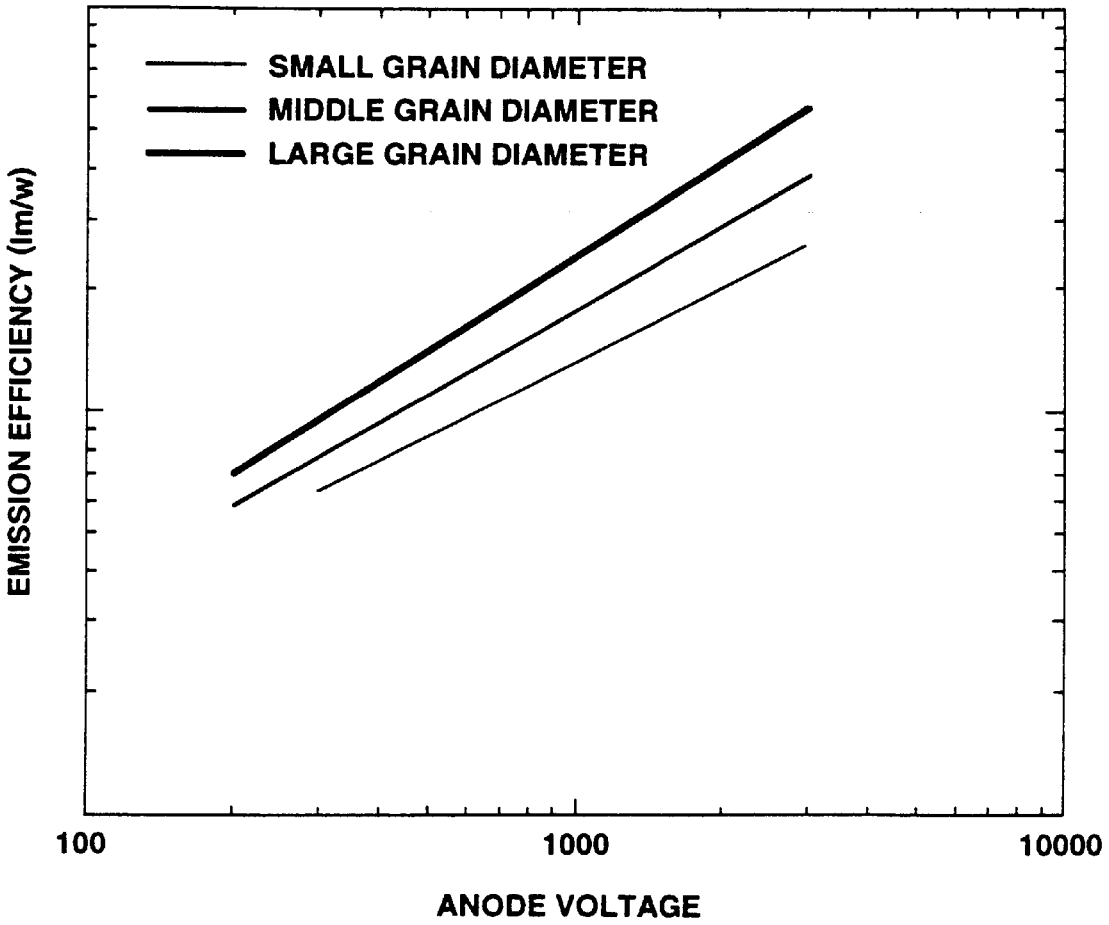
FIG. 6 is a graph showing dependency of emission efficiency on the anode voltage with respect to the fluophor.

The emission efficiency of the fluophor 10 is changed with the anode voltage applied onto the anode electrode as shown in FIG. 6. FIG. 6 is a graph showing the emission efficiency of the fluophor on the axis of ordinance and the anode voltage on the axis of abscissa. As shown in FIG. 5, the emission efficiency of the fluophor 10 keeps an index relation with the anode voltage. The emission efficiency of the fluophor 10 is changed with the grain diameter of the fluophor formed on the fluorescent screen 9 of the anode electrode side. When the grain is large in diameter, the emission efficiency is great, while when the grain is small in diameter, the emission efficiency is small. In addition, irrespective of the grain diameter, the emission efficiency keeps a substantially index relation with the anode voltage.

Hence, if the grain diameter of the fluophor is made larger by thinning the Al film 12, it is possible to improve the emission efficiency of the fluophor 10.

On the other hand, the Al film 12 is formed so as to reflect the emission from the fluophors 10 onto the front plane of the panel. By changing the film thickness of the Al film 12, the reflection factor of the Al film 12 is changed as shown in FIG. 7.

Figure 7:
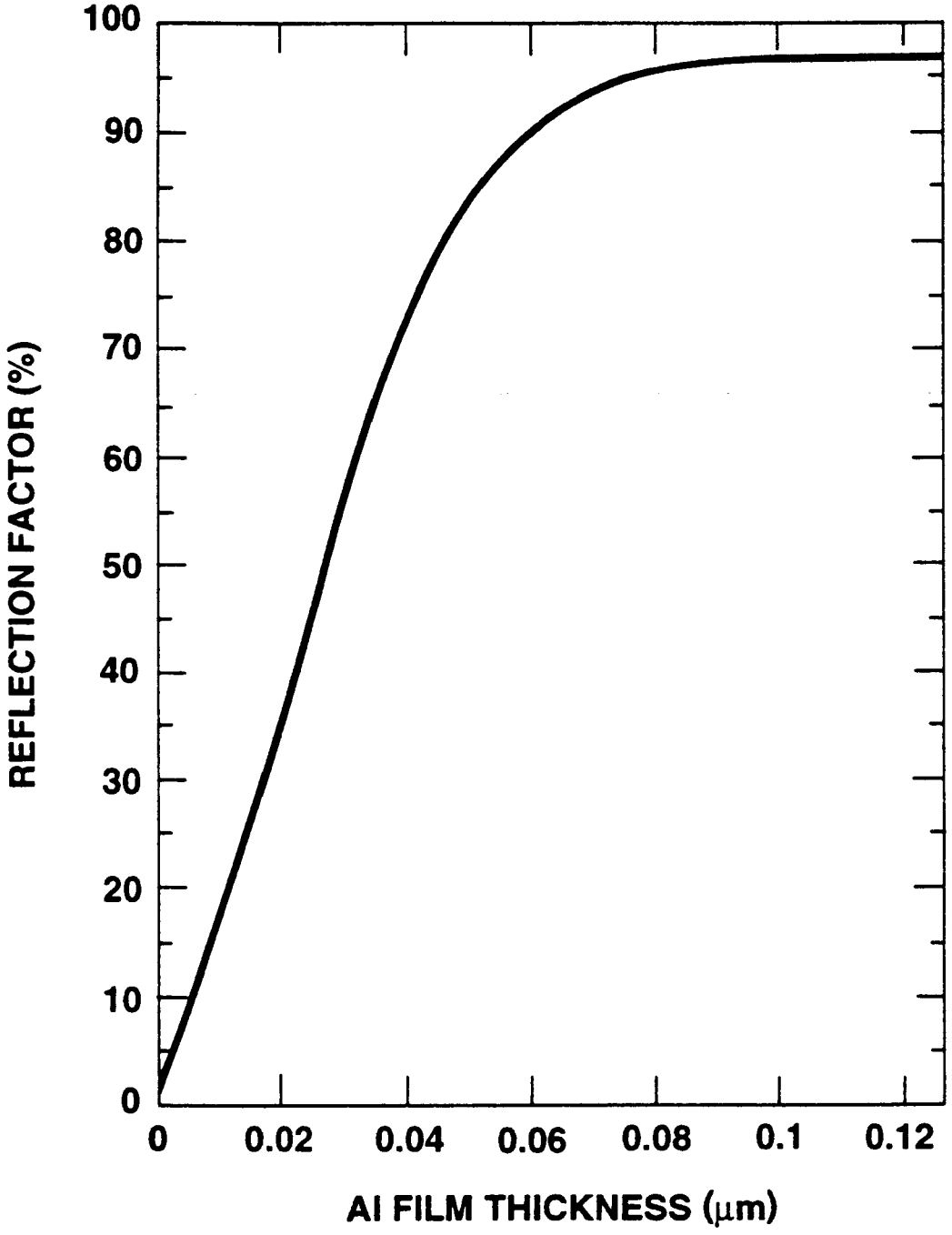
FIG. 7 is a graph showing dependency of a reflection factor of the AI film on a thickness of the AI film.

FIG. 7 is a graph showing a reflection factor on an axis of ordinance and a thickness of the Al film 12 on an axis of abscissa. In the graph of FIG. 7 showing the relation between the film thickness and the reflection factor of the Al film 12, the ray of light applied to the Al film 12 have a wavelength of 0.5 μm.

As indicated in the graph of FIG. 7, when the Al film 12 has a thickness of about 0 to 0.06 [μm], the reflection factor is improved in substantially proportion to the thickness of the Al film 12. When the Al film 12 has a thickness of about 0.08 [μm] or more, the reflection factor reaches 100%. When the film has a thickness of about 0 to 0.06 [μm], a part of the emission is reflected on the Al film 12 and another part of the emission is absorbed by and passed through the Al film 12. Further, in case the Al film has a thickness of about 0.08 [μm] or more, the emission from the fluophors 10 is not absorbed by or passed through the Al film but mirror reflected on the Al film.

If, therefore, the Al film 12 is getting thicker and thicker, the Al film 12 is more likely to absorb the kinetic energy of the electrons for exciting the fluophors 10 and reduce the luminance but have a larger reflection factor. It means that the luminance can be improved by reflecting the emission from the fluophors 10 toward the cathode lines 6.

In general, if the fluophors 10 are excited by an electron line for emitting light, the relation between the anode voltage for improving the kinetic energy of the electrons and the emission efficiency of the fluophor 10 is represented by the following expression (1)

$$\rho=C\cdot E^{\gamma} \tag{1}$$

where ρ indicates an emission efficiency of the fluophor 10, C and γ indicate constants, and E indicates an anode voltage.

Hence, the thickness of the Al film 12 for maximizing the luminance is changed on the dependency index of the emission efficiency of the fluophor 10 against the voltage.

Figures 8, 9:
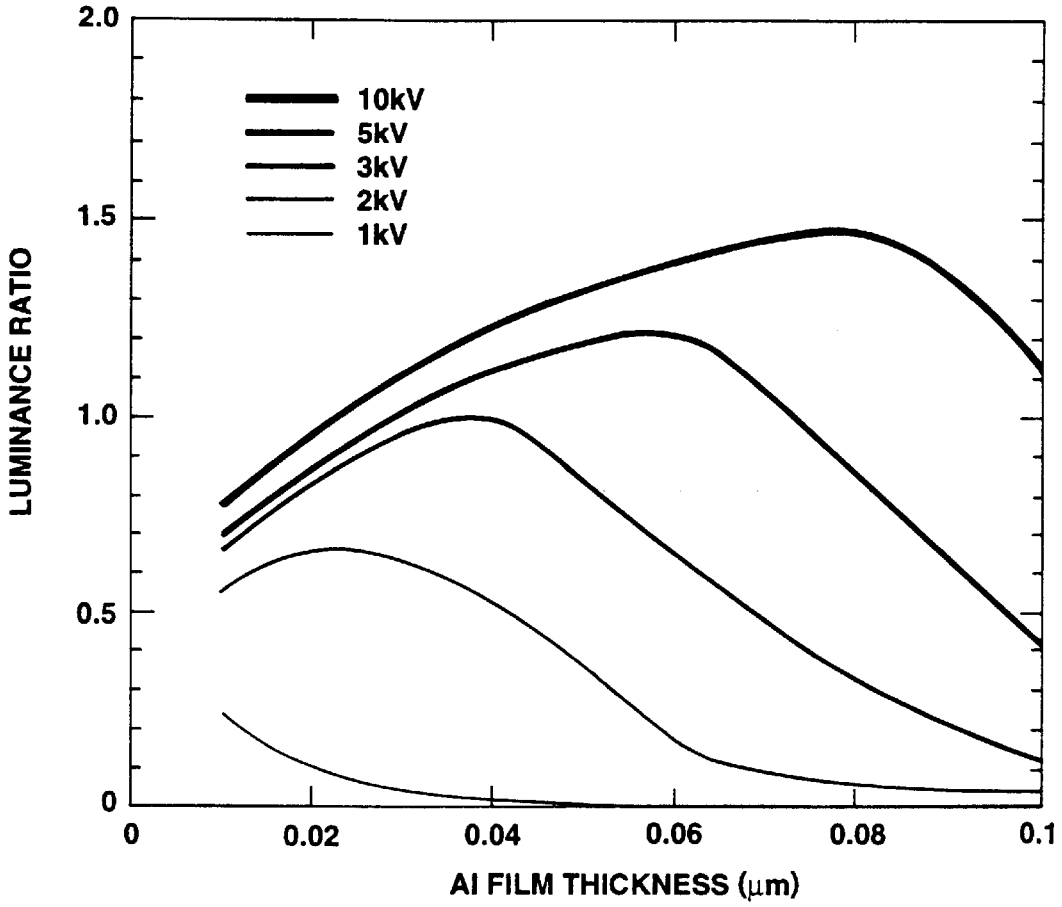
FIG. 8 is a graph showing dependency of a luminance ratio of the composition with the AI film to the composition without the AI film on a thickness of the AI film.
FIG. 9 is a graph showing a film thickness for an optimal luminance in the case that the anode voltage to be applied is 1, 2, 3, 5 or 10 kV.

As shown in FIG. 8, when using $Y_2O_2S$:Eu, ZnS:Cu, Al, ZnS:Ag, Al, $ZnGa_2O_4$:Mn or the like as the fluophor 10 with the dependency index of about 0.3 to 1.5, the luminance ratio becomes a peak when the Al film 12 stays in the range of about 0.02 [μm] to 0.1 [μm].

FIG. 8 shows dependency of a luminance ratio on the Al film at the anode voltage of 1 to 10 [kV], the luminance ratio of the composition with the Al film 12 to the composition without the Al film 12. This luminance ratio indicates a ratio of a luminance of the Al film 12 formed on the overall lower surface of the fluophor 10 to no Al film 12 formed thereon.

As indicated in the graph of FIG. 8, with increase of the voltage to be applied to the anode electrode, the luminance ratio is generally increased. The luminance ratio reaches a peak except a voltage of 1 [kV] applied to the anode electrode.

The relation between the thickness of the Al film 12 and the luminance ratio in the range of the anode voltage from 1 to 10 kV keeps stable in the wavelength of a visible ray. Hence, there exists an optimal film thickness of the luminance characteristic for the fluorescent screens 9 corresponding to the R, G and B.

Therefore, it is possible to more enhance the emission efficiency by determining the thickness of the Al film 12 at the peak of the luminance ratio. The optimal thickness of the Al film 12 at which the luminance ratio shown in FIG. 8 reaches a peak value is 0.01, 0.022, 0.039, 0.06 or 0.08 [μm] at the anode voltage of 1, 2, 3, 5 or 10 [kV] as shown in FIG. 9. Hence, by keeping the thickness of the Al film 12 optimal as shown in FIGS. 8 and 9, it is possible to obtain the field emission display with the optimal luminance characteristic.

However, the absolute value of the luminance is influenced by some factors such as an emission efficiency of the fluophor 10 and a smoothness of the Al film 12. By keeping the thickness of the Al film 12 optimal according to the factors, it is possible to enhance double the luminance ratio at maximum.

Figure 10:
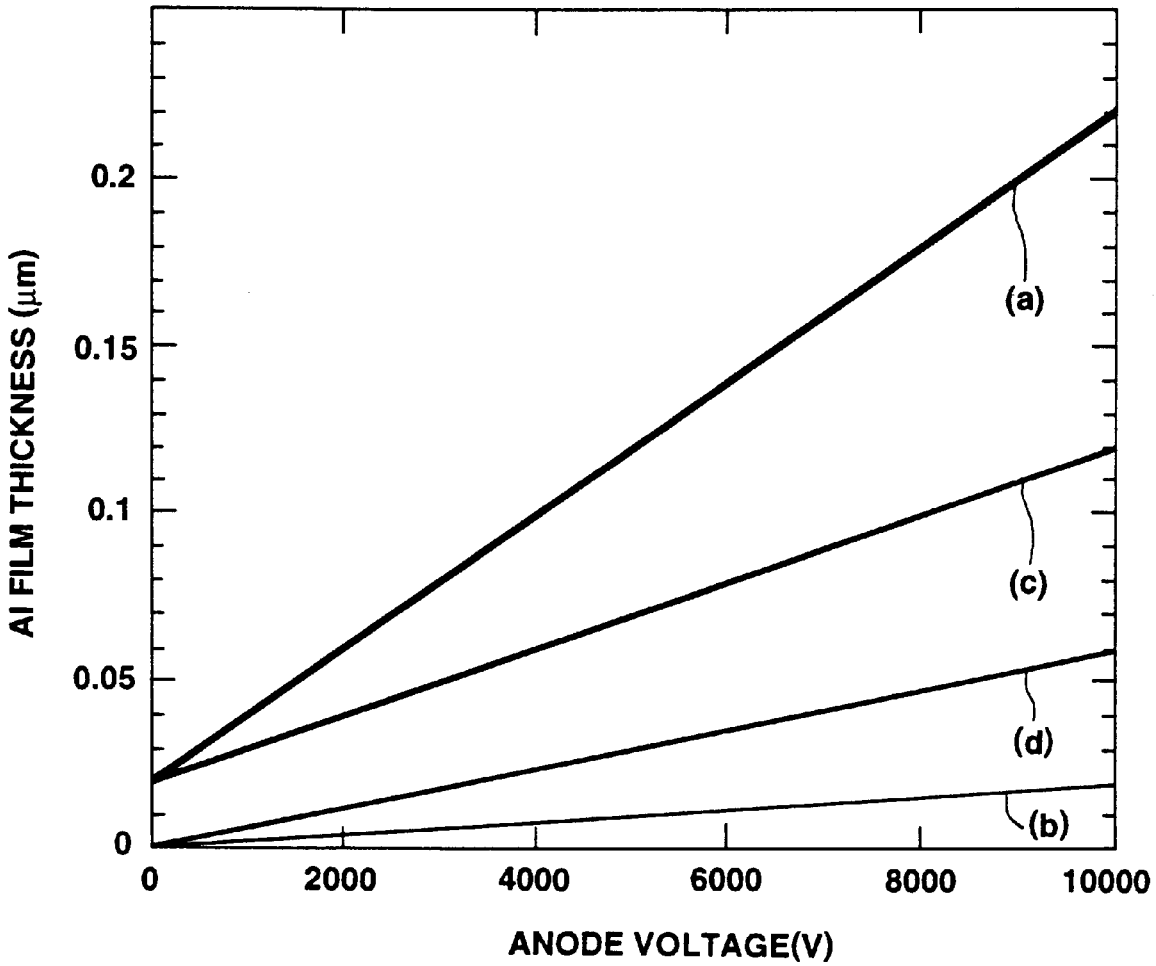
FIG. 10 is a graph showing dependency of the thickness of the AI film on the anode voltage.

The thickness of the Al film 12 has its optimal value and the range of the optimal thickness is determined on the factors such as the smoothness of the Al film 12 as shown in FIG. 10. FIG. 10 is a graph showing the thickness of the Al film 12 on the axis of ordinance and the anode voltage on the axis of abscissa. The curve (a) of FIG. 10 indicates an upper limit of the preferable thickness of the Al film 12 against the anode voltage. The curve (b) of FIG. 10 indicates a lower limit of the preferable thickness of the Al film 12 against the anode voltage. As indicated in the curves (a) and (b) of FIG. 10, for forming the fluorescent screen 9 with the optimal luminance, the thickness of the Al film 12 is just needed to keep the relation of:

$$2\times10^{-6}E<t<2\times10^{-5}E+0.02 \tag{2}$$

wherein t [μm] is a thickness of the Al film 12 and E is an anode voltage.

In the condition that the anode voltage E is about 1 [kV], the thickness t of the Al film 12 formed according to the foregoing relation (2) keeps the range of:

$$0.02\ [\mu m]<t<0.22\ [\mu m]$$

As set forth above, the Al film 12 formed as above is allowed to enhance the reflection factor of the luminous emission to the anode electrode side, that is, the luminance except the case that the anode voltage is quite small. At a time, the power consumption can be reduced if the luminance is kept constant.

Further, this Al film 12 serves to prevent the reflection of rays toward the cathode lines 6 and the anode lines and the luminous emission toward the anode electrode side, and enhance the luminance and the contrast.

Moreover, the Al film 12 has a function of protecting the fluophor 10 from being stripped off the substrate. This function makes it possible to prevent a shortcoming such as release of the stripped fluophor 10 to vacuum or contact of the stripped fluophor with the electron emission source, thereby improving the reliability.

As a result of stripping the fluophor 10, gas is discharged from the fluophor 10 and thereby develops a discharge phenomenon in vacuum. By forming the Al film 12, therefore, it is possible to prevent the release of the gas in vacuum and the electric discharge caused by the discharged gas.

In case that the fluophor 10 does not have sufficient conductivity, when the fluophor 10 is excited by electrons, the Al film 12 serves to suppress a disadvantageous phenomenon where the overall substrate is so charged up that the surface potential of the fluorescent screen 9 is lower than the predetermined anode voltage and the luminance is reduced accordingly. That is, the Al film 12 enables to keep the luminance constant.

With reduction of the Al film 12 in thickness, the foregoing effects are all diminished. Nevertheless, those effects are satisfied in case the Al film 12 has an optimal thickness.

As indicated in the curves (c) and (d) of FIG. 10, by forming the Al film 12 to keep its thickness t in the range of:

$$6\times10^{-6}E<t<1\times10^{-5}E+0.02 \quad (3)$$

The Al film 12 formed according to the expression (3) keeps the range of 0.06 [μm]<t<0.12 [μm] when the anode voltage is about 10 kV.

The Al film 12 formed as described above serves to more improve the luminance and the contrast, suppress the discharge and prevent the substrate from being charged excessively.

Figure 11:
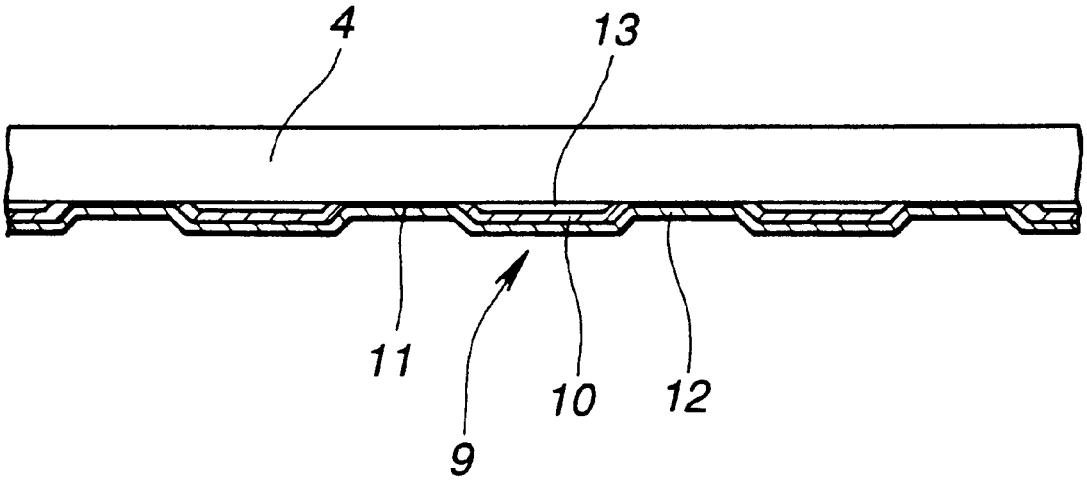
FIG. 11 is a schematic view showing a fluorescent screen formed in the state of forming a conductive transparent film between the substrate and the fluophor.

The fluorescent screen 9 formed as described above may be configured to locate a transparent conductive film 13 between the glass substrate 4 and the fluophors 10 as shown in FIG. 11.

The upper substrate 4 shown in FIG. 11 includes on the side opposed to the cathode lines 6 of the upper substrate 4 the fluophors 4 excited by an electron ray for emitting light, the black masks 11, the metal film 12 such as the Al film formed under the fluophors 10 and the black masks 11, and a conductive material located between the fluophors 10 and the upper substrate 4.

Only if the upper substrate 4 is formed so that the thickness of the Al film 12 meets the foregoing expressions (2) and (3), the resulting upper substrate 4 serves to protect the substrate from charged excessively, improve the luminance and the contrast, and suppress the disadvantageous electric discharge.

As set forth above, the field emission display device according to the present invention includes the cathode electrode, the fluophors excited by electrons emitted from the cathode electrode for emitting light, the anode electrode to which the voltage is to be applied, and the metal film formed on the fluophors as opposed to the cathode electrode. The metal film serves to improve a reflection factor of the fluophors toward the cathode electrode side, that is, the luminance of the fluophors as well as reduce the power consumption if the luminance is kept constant.

This field emission display device includes the metal film formed thereon. This metal film serves to prevent the reflection of the luminous emission of the fluophors to the cathode lines and the gate lines and thereby improve the contrast.

This field emission display device has a function of protecting the fluophor from being stripped. This function makes it possible to prevent the shortcoming that the stripped fluophor is in vacuum or keeps in touch with the electron emitting source and improve the reliability accordingly.

Further, the gas is discharged from the fluophors when those fluophors are heated by electron radiations. The gas develops the discharge phenomenon in vacuum. Hence, the formation of the metal film makes it possible to prevent the fluophors from release into vacuum and the electric discharge caused by the gas.

In case the fluophors do not have sufficient conductivity, when the fluophors are excited by electrons, the metal film makes it possible to suppress the phenomenon where the substrate is so charged up that the surface potential of the fluorescent screen is lower than the predetermined anode voltage and the luminance is reduced accordingly. It means that the metal film serves to keep the luminance constant.

Many widely different embodiments of the present invention may be constructed without departing from the spirit and scope of the present invention. It should be understood that the present invention is not limited to the specific embodiments described in the specification, except as defined in the appended claims.

What is claimed is:

1. A field emission display device comprising:

a cathode electrode;

a fluorescent screen with fluophors excited by electrons emitted from said cathode electrode so that said fluophors emit light;

an anode electrode to which a given anode voltage is to be applied; and a metal film formed on said fluophors facing said cathode electrode, wherein said metal film has a thickness t in the range of:

$$2\times10^{-6}E(v)<t<2\times10^{-5}E(v)+0.02$$

where t is a thickness of said metal film in micrometers and E (v) is the voltage to be applied onto said anode electrode in volts so that electrodes discharged from said cathode electrode passes through said metal film to the fluophors and emissions from said fluophors are reflected onto a front plane of the field emission display device.

2. The field emission display device as claimed in claim 1, wherein said metal film is made of aluminium (Al).

3. The field emission display device as claimed in claim 1, wherein said metal film has a thickness in the range of:

$$6\times10^{-6}E<t<1\times10^{-5}E+0.02.$$

* * * * *